US007187351B2

(12) United States Patent
Kwon

(10) Patent No.: US 7,187,351 B2
(45) Date of Patent: Mar. 6, 2007

(54) LIGHT EMITTING DISPLAY, DISPLAY PANEL, AND DRIVING METHOD THEREOF

(75) Inventor: Oh-Kyong Kwon, Seoul (KR)

(73) Assignee: Samsung SDI Co., Ltd., Suwon-si (KR)

( * ) Notice: Subject to any disclaimer, the term of this patent is extended or adjusted under 35 U.S.C. 154(b) by 580 days.

(21) Appl. No.: 10/729,504

(22) Filed: Dec. 4, 2003

(65) Prior Publication Data

US 2004/0196223 A1 Oct. 7, 2004

(30) Foreign Application Priority Data

Apr. 1, 2003 (KR) ..... 10-2003-0020433

(51) Int. Cl.
*G09G 3/32* (2006.01)

(52) U.S. Cl. ..... 345/82; 345/76; 345/204; 315/169.4

(58) Field of Classification Search ..... 345/76–82, 345/204, 211; 315/169.1, 169.3, 169.4
See application file for complete search history.

(56) References Cited

U.S. PATENT DOCUMENTS 5,952,789 A * 9/1999 Stewart et al. ..... 315/169.4
6,229,506 B1 5/2001 Dawson et al.
6,580,408 B1 * 6/2003 Bae et al. ..... 345/76
6,670,773 B2 * 12/2003 Nakamura et al. ..... 315/169.3
6,686,699 B2 * 2/2004 Yumoto ..... 315/169.3
6,806,857 B2 * 10/2004 Sempel et al. ..... 345/92
6,847,171 B2 * 1/2005 Tam ..... 315/169.3
7,019,717 B2 * 3/2006 Yumoto et al. ..... 345/76
2002/0196212 A1 * 12/2002 Nishitoba et al. ..... 345/76
2003/0011584 A1 * 1/2003 Azami et al. ..... 345/204
2003/0178946 A1 * 9/2003 Nakamura et al. ..... 315/169.3
2004/0056604 A1 * 3/2004 Shih et al. ..... 315/169.2

OTHER PUBLICATIONS

A. Yumoto et al; "Pixel-Driving Methods for Large-Sized Poly-Si AM-OLED Displays"; Asia Display/IDW '01, Proceedings of the 21st International Display Research Conference in Conjunction with the 8th International Display Workshops, Nagoya, Japan, Oct. 16, 2001, vol. 21/8, pp. 1395-1398.
Y. He et al, "Current-Source a-Si:H Thin -Film Transistor Circuit for Active-Matrix Organic LIght-Emitting Displays"; IEEE Electron Device Letters, vol. 21, No. 12, Dec. 2000, pp. 590-592.
European Search Report for Application No. 03090383.5, dated Aug. 17, 2004, in the name of Samsung SDI Co., Ltd.

* cited by examiner

*Primary Examiner*—Richard Hjerpe
*Assistant Examiner*—Kimnhung Nguyen
(74) *Attorney, Agent, or Firm*—Christie, Parker & Hale, LLP

(57) ABSTRACT

A light emitting display driven by a data current. A first voltage corresponding to the data current is applied to a first capacitor formed between a gate and a source of a driving transistor. A second voltage corresponding to a threshold voltage of the driving transistor is applied to a second capacitor formed between the gate and source thereof. The first and second capacitors are coupled to establish the voltage between the gate and source thereof as a third voltage, and a driving current from the driving transistor is transmitted to a light emitting element. In this instance, the driving current is determined by the third voltage.

20 Claims, 6 Drawing Sheets

LIGHT EMITTING DISPLAY, DISPLAY PANEL, AND DRIVING METHOD THEREOF

CROSS REFERENCE TO RELATED APPLICATION

This application claims priority to and the benefit of Korea Patent Application No. 2003-20433 filed on Apr. 1, 2003 in the Korean Intellectual Property Office, the content of which is incorporated herein by reference.

BACKGROUND OF THE INVENTION (a) Field of the Invention

The present invention relates to a light emitting display, a display panel, and a driving method thereof. More specifically, the present invention relates to an organic electroluminescent (EL) display.

(b) Description of the Related Art

In general, an organic EL display electrically excites a phosphorous organic compound to emit light, and it voltage- or current-drives N×M organic emitting cells to display images. As shown in FIG. 1, an organic emitting cell includes an anode of indium tin oxide (ITO), an organic thin film, and a cathode layer metal. The organic thin film has a multi-layer structure including an emitting layer (EML), an electron transport layer (ETL), and a hole transport layer (HTL) for maintaining balance between electrons and holes and improving emitting efficiencies, and it further includes an electron injecting layer (EIL) and a hole injecting layer (HIL).

Methods for driving the organic emitting cells include the passive matrix method, and the active matrix method using thin film transistors (TFTS) or metal oxide semiconductor field effect transistors (MOSFETs). The passive matrix method forms cathodes and anodes to cross with each other, and selectively drives lines. The active matrix method connects a TFT and a capacitor with each ITO pixel electrode to thereby maintain a predetermined voltage according to capacitance. The active matrix method is classified as a voltage programming method or a current programming method according to signal forms supplied for maintaining a voltage at a capacitor.

Referring to FIGS. 2 and 3, conventional organic EL displays of the voltage programming and current programming methods will be described.

FIG. 2 shows a conventional voltage programming type pixel circuit for driving an organic EL element, representing one of N×M pixels. Referring to FIG. 2, transistor M1 is coupled to an organic EL element (referred to as an OLED hereinafter) to thus supply current for light emission. The current of transistor M1 is controlled by a data voltage applied through switching transistor M2. In this instance, capacitor C1 for maintaining the applied voltage for a predetermined period is coupled between a source and a gate of the transistor M1. Scan line $S_n$ is coupled to a gate of transistor M2, and data line Dm is coupled to a source thereof.

As to an operation of the above-configured pixel, when transistor M2 is turned on according to a select signal applied to the gate of switching transistor M2, a data voltage from data line Dm is applied to the gate of transistor M1. Accordingly, current $I_{OLED}$ flows to transistor M2 in correspondence to a voltage $V_{GS}$ charged between the gate and the source by capacitor C1, and the OLED emits light in correspondence to current $I_{OLED}$.

In this instance, the current that flows to the OLED is given in Equation 1.

$$I_{OLED} = \frac{\beta}{2}(V_{GS} - V_{TH})^2 = \frac{\beta}{2}(V_{DD} - V_{DATA} - |V_{TH}|)^2 \quad \text{Equation 1}$$

where $I_{OLED}$ is the current flowing to the OLED, $V_{GS}$ is a voltage between the source and the gate of transistor M1, $V_{TH}$ is a threshold voltage at transistor M1, and β is a constant.

As given in Equation 1, the current corresponding to the applied data voltage is supplied to the OLED, and the OLED gives light in correspondence to the supplied current, according to the pixel circuit of FIG. 2. In this instance, the applied data voltage has multi-stage values within a predetermined range so as to represent gray.

However, the conventional pixel circuit following the voltage programming method has a problem in that it is difficult to obtain high gray because of deviation of a threshold voltage $V_{TH}$ of a TFT and deviations of electron mobility caused by non-uniformity of an assembly process. For example, in the case of driving a TFT of a pixel with 3 volts (3V), voltages are to be supplied to the gate of the TFT for each interval of 12 mV (=3V/256) so as to represent 8-bit (256) grays, and if the threshold voltage of the TFT caused by the non-uniformity of the assembly process deviates, it is difficult to represent high gray. Also, since the value β in Equation 1 changes because of the deviations of the electron mobility, it becomes even more difficult to represent the high gray.

On assuming that the current source for supplying the current to the pixel circuit is uniform over the whole panel, the pixel circuit of the current programming method can achieve uniform display features even though a driving transistor in each pixel has non-uniform voltage-current characteristics.

FIG. 3 shows a pixel circuit of a conventional current programming method for driving the OLED, representing one of N×M pixels. Referring to FIG. 3, transistor M1 is coupled to the OLED to supply the current for light emission, and the current of transistor M1 is controlled by the data current applied through transistor M2.

First, when transistors M2 and M3 are turned on because of the select signal from scan line $S_n$, transistor M1 becomes diode-connected, and the voltage matched with data current $I_{DATA}$ from data line Dm is stored in capacitor C1. Next, the select signal from scan line $S_n$ becomes high-level to turn on transistor M4. Then, the power is supplied from power supply voltage VDD, and the current matched with the voltage stored in capacitor C1 flows to the OLED to emit light. In this instance, the current flowing to the OLED is as follows.

$$I_{OLED} = \frac{\beta}{2}(V_{GS} - V_{TH})^2 = I_{DATA} \quad \text{Equation 2}$$

where $V_{GS}$ is a voltage between the source and the gate of the transistor M1, $V_{TH}$ is a threshold voltage at transistor M1, and β is a constant.

As given in Equation 2, since current $I_{OLED}$ flowing to the OLED is the same as data current $I_{DATA}$ in the conventional current pixel circuit, uniform characteristics can be obtained when the programming current source is set to be uniform over the whole panel. However, since current $I_{OLED}$ flowing to the OLED is a fine current, control over the pixel circuit by fine current $I_{DATA}$ problematically requires much time to charge the data line. For example, assuming that the load capacitance of the data line is 30 pF, it requires several milliseconds of time to charge the load of the data line with the data current of several tens to hundreds of nA. This causes a problem that the charging time is not sufficient in consideration of the line time of several tens of microseconds.

SUMMARY OF THE INVENTION

In accordance with the present invention to a light emitting display is provided for compensating for the threshold voltage of transistors or for electron mobility, and sufficiently charging the data line.

In one aspect of the present invention, a light emitting display is provided on which are formed a plurality of data lines for transmitting data current that displays video signals, a plurality of scan lines for transmitting a select signal, and a plurality of pixel circuits formed at a plurality of pixels defined by the data lines and the scan lines. The pixel circuit includes: a light emitting element for emitting light corresponding to the applied current; a first transistor, having first and second main electrodes and a control electrode, for supplying a driving current for the light emitting element; a first switch for diode-connecting the first transistor in response to a first control signal; a second switch for transmitting a data signal from the data line in response to the select signal from the scan line; a first storage element for storing a first voltage corresponding to the data current from the second switch in response to a second control signal; a second storage element for storing a second voltage corresponding to a threshold voltage of the first transistor in response to a disable level of the second control signal; and a third switch for transmitting the driving current from the first transistor to the light emitting element in response to a third control signal, wherein the second voltage is applied to the second storage element after the first voltage is applied to the first storage element, and a third voltage stored in the first storage element is applied to the first transistor by coupling of the first and second storage elements to output the driving current. The pixel circuit further includes a fourth switch that is turned on in response to the second control signal and has a first end coupled to a control electrode of the first transistor, and the fourth switch is turned on to form the first storage element, and the fourth switch is turned off to form the second storage element. The second storage element is formed by a first capacitor coupled between a control electrode and a first main electrode of the first transistor. The first storage element is formed by parallel coupling of first and second capacitors, the second capacitor being coupled between the first main electrode of the first transistor and a second end of the fourth switch. The first storage element is formed by a first capacitor coupled between a second end of the fourth switch and a first main electrode of the first transistor. The second storage element is formed by serial coupling of first and second capacitors, the second capacitor being coupled between the second end of the fourth switch and the control electrode of the first transistor. The first control signal is formed by the first select signal and a second select signal from a next scan line having an enable interval after the first select signal. The first switch includes a second transistor for diode-connecting the first transistor in response to the first select signal, and a third transistor for diode-connecting the first transistor in response to the second select signal. The second control signal is formed by the first select signal and the third control signal. The pixel circuit further includes a fifth switch coupled in parallel to the fourth switch. The fourth and fifth switches are respectively turned on in response to the first select signal and the third control signal.

In another aspect of the present invention, a method is provided for driving a light emitting display having a pixel circuit including a switch for transmitting a data current from a data line in response to a select signal from a scan line, a transistor including first and second main electrodes and a control electrode for outputting the driving current in response to the data current, and a light emitting element for emitting light corresponding to the driving current from the transistor. A first voltage is stored corresponding to a data current from the switch in a first storage element formed between the control electrode and the first main electrode of the transistor. A second voltage corresponding to a threshold voltage of the transistor is applied to a second storage element formed between the control electrode and the first main electrode of the transistor. The first and second storage elements are coupled to establish the voltage between the control electrode and the first main electrode of the transistor as a third voltage. The driving current is transmitted from the transistor to the light emitting display. The driving current from the transistor is determined corresponding to the third voltage.

In still another aspect of the present invention, a display panel of a light emitting display is provided, on which are formed a plurality of data lines for transmitting the data current that displays video signals, a plurality of scan lines for transmitting a select signal, and a plurality of pixel circuits formed at a plurality of pixels defined by the data lines and the scan lines. The pixel circuit includes: a light emitting element for emitting light corresponding to the applied current; a first transistor for outputting the current for driving the light emitting element; a first switch for transmitting the data current from the data line to the first transistor in response to a first select signal from the scan line; a second switch diode-connecting the first transistor in response to a first control signal; a third switch for operating in response to a second control signal; a fourth switch for transmitting the driving current from the transistor to the light emitting element in response to a third control signal; a first storage element formed between a control electrode and a first main electrode of the first transistor when the third switch is turned on; and a second storage element formed between the control electrode and the first main electrode of the first transistor when the third switch is turned off. The display panel operates in the order of: a first interval for applying a first voltage corresponding to the data current to the first storage element, a second interval for applying a second voltage corresponding to a threshold voltage of the first transistor to the second storage element, and a third interval for generating the driving current by a third voltage stored in the first storage element by the first and second voltages.

DETAILED DESCRIPTION

An organic EL display, a corresponding pixel circuit, and a driving method thereof will be described in detail with reference to drawings.

Figure 1:
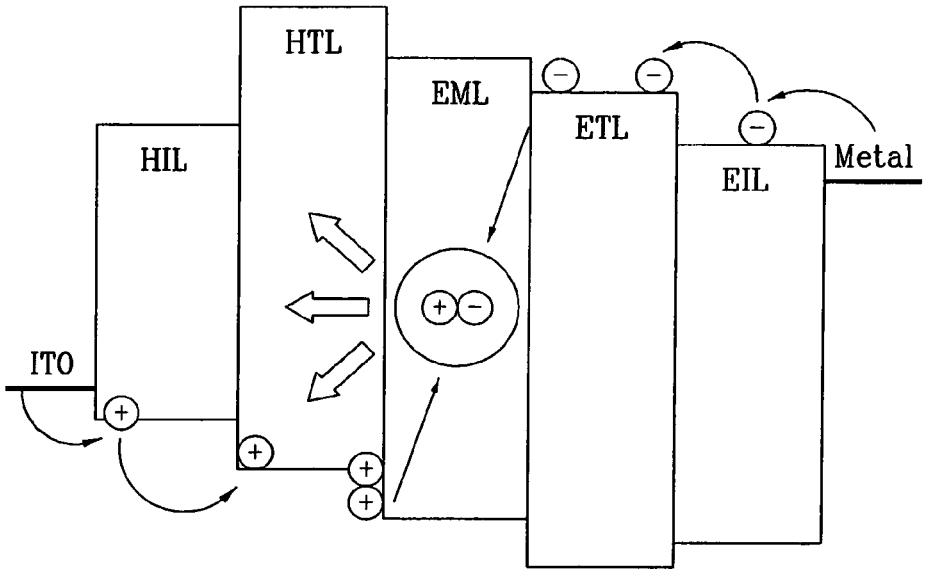
FIG. 1 shows a concept diagram of an OLED.
Figure 2:
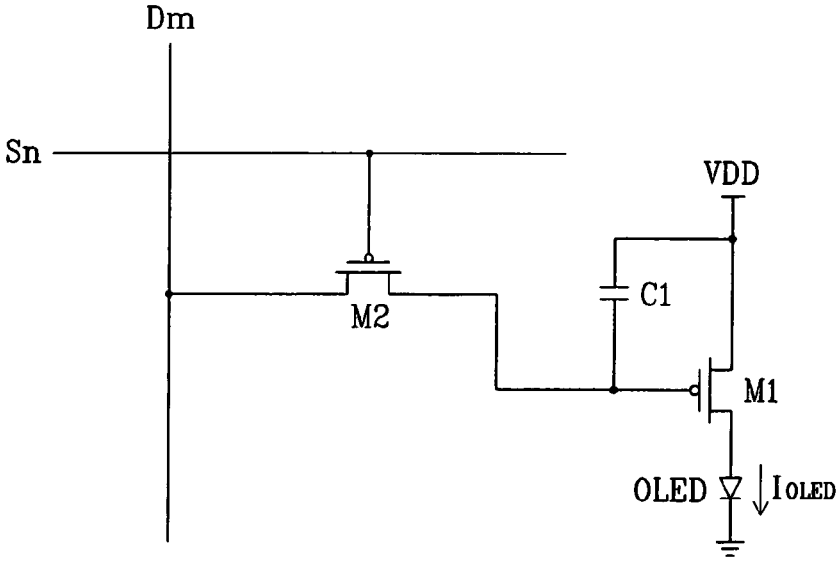
FIG. 2 shows an equivalent circuit of a conventional pixel circuit following the voltage programming method.
Figure 3:
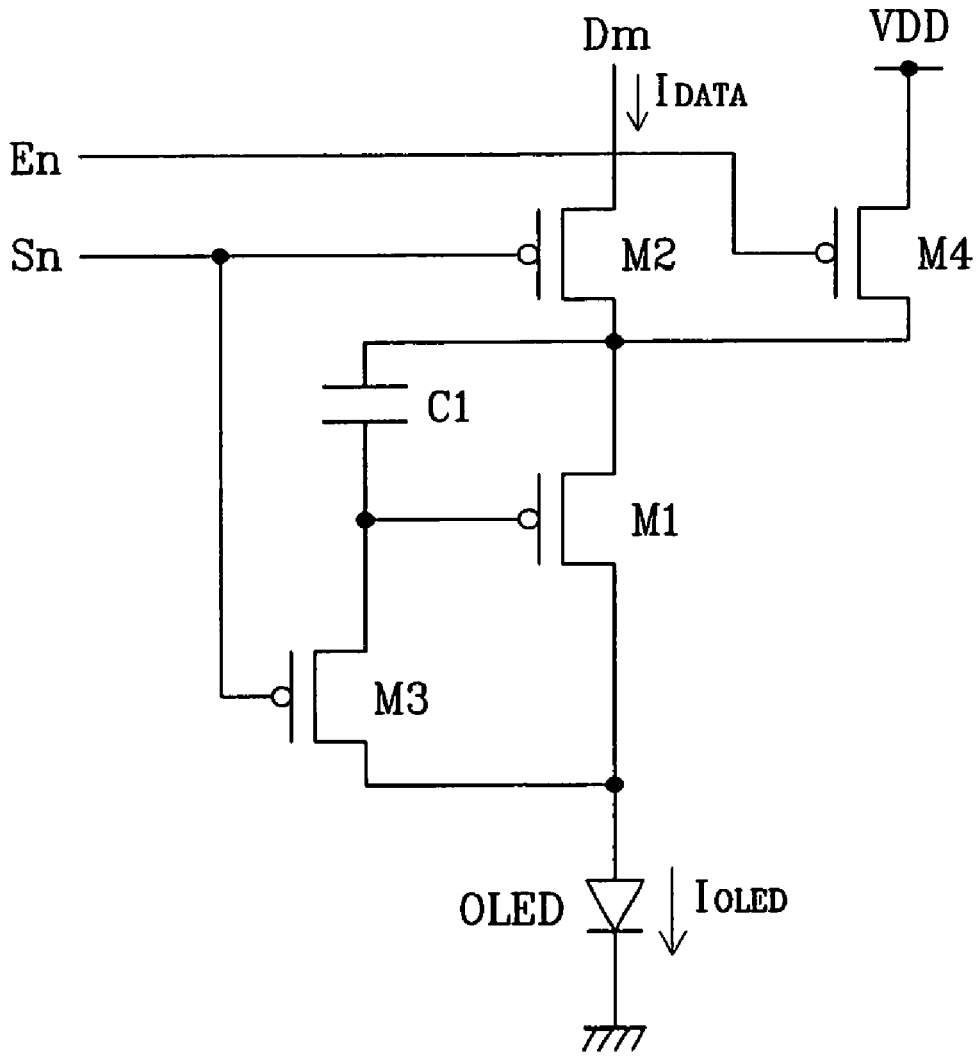
FIG. 3 shows an equivalent circuit of a conventional pixel circuit following the current programming method.
Figure 4:
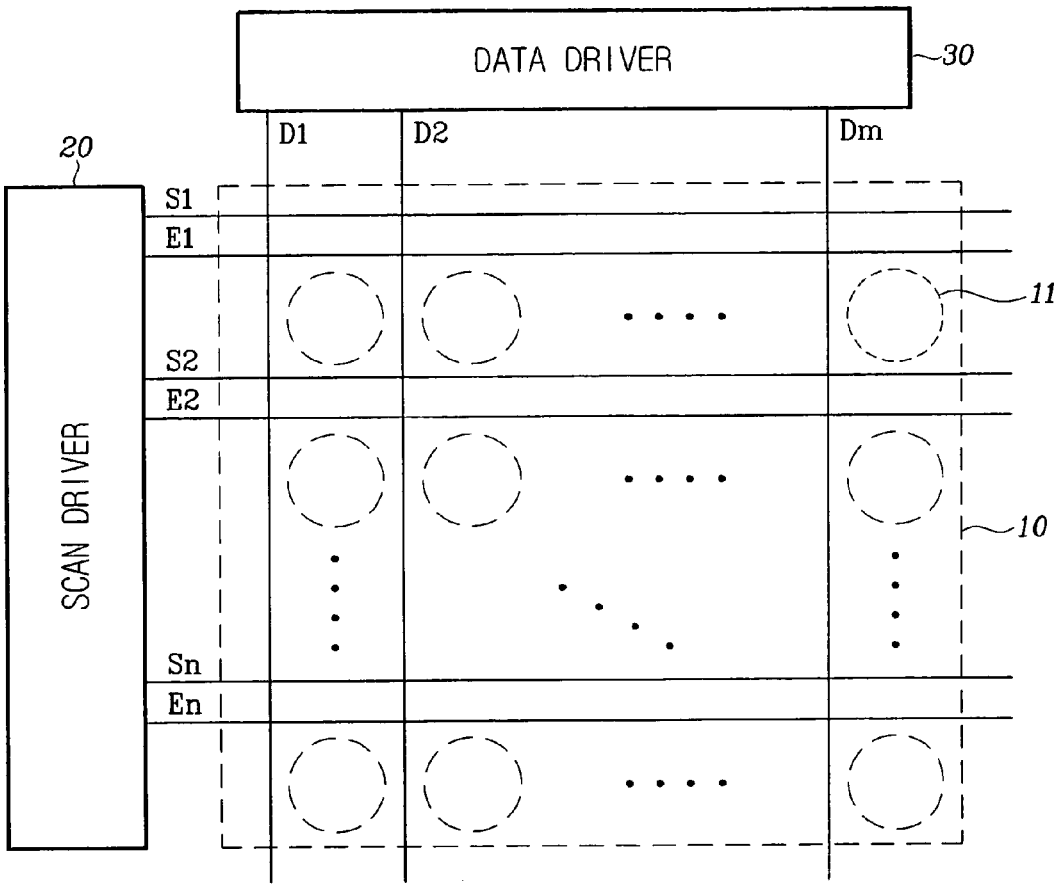
FIG. 4 shows a brief plane diagram of an organic EL display according to an embodiment of the present invention.

First, referring to FIG. 4, the organic EL display will be described. FIG. 4 shows a brief ground plan of the OLED.

As shown, the organic EL display includes an organic EL display panel 10, scan driver 20, and data driver 30.

Organic EL display panel 10 includes a plurality of data lines $D_1$ through $D_m$ in the row direction, a plurality of scan lines $S_1$ through $S_n$ and $E_1$ through $E_n$, and a plurality of pixel circuits 11. Data lines $D_1$ through $D_m$ transmit data signals that represent video signals to the pixel circuit 11, and scan lines $S_1$ through $S_n$ transmit select signals to pixel circuit 11. Pixel circuit 11 is formed at a pixel region defined by two adjacent data lines $D_1$ through $D_m$ and two adjacent scan lines $S_1$ through $S_n$. Also, scan lines $E_1$ through $E_n$ transmit emit signals for controlling emission of pixel circuits 11.

Scan driver 20 sequentially applies respective select signals and emit signals to the scan lines $S_1$ through $S_n$ and $E_1$ through $E_n$. The data driver 30 applies the data current that represents video signals to the data lines $D_1$ through $D_m$.

Scan driver 20 and/or data driver 30 can be coupled to display panel 10, or can be installed, in a chip format, in a tape carrier package (TCP) coupled to display panel 10. The same can be attached to display panel 10, and installed, in a chip format, on a flexible printed circuit (FPC) or a film coupled to display panel 10, which is referred to as a chip on flexible board, or chip on film (CoF) method. Differing from this, scan driver 20 and/or data driver 30 can be installed on the glass substrate of the display panel, and further, the same can be substituted for the driving circuit formed in the same layers of the scan lines, the data lines, and TFTs on the glass substrate, or directly installed on the glass substrate, which is referred to as a chip on glass (CoG) method.

Figure 5:
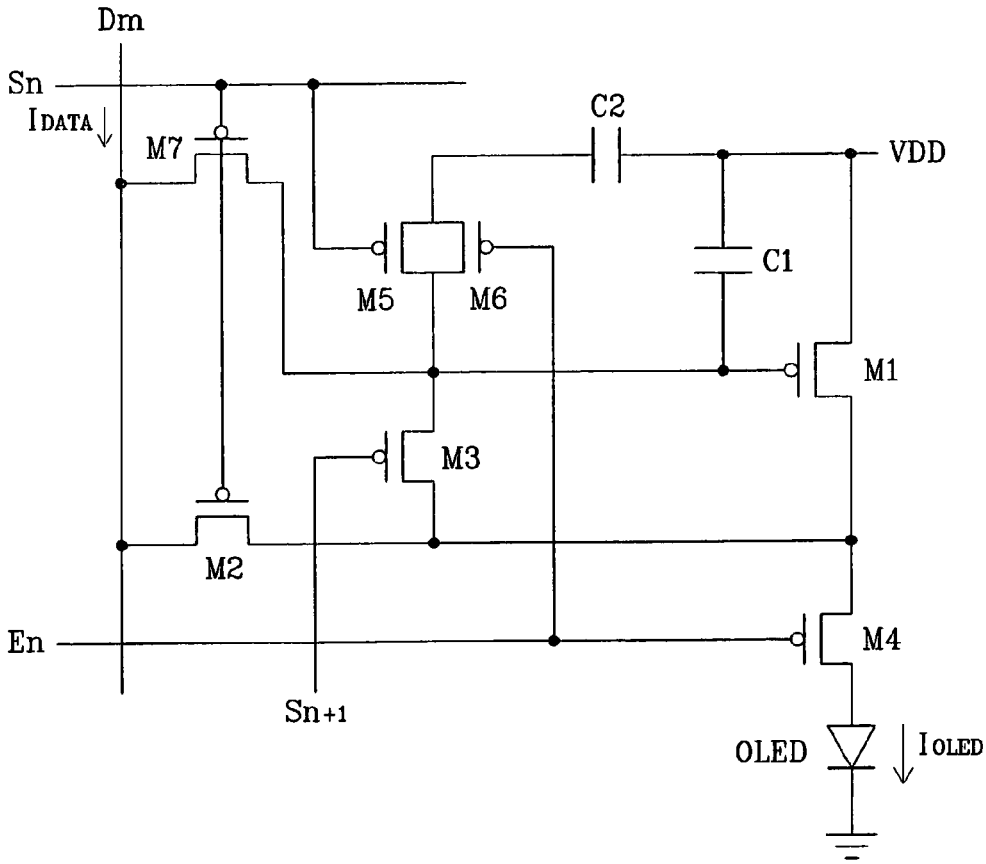
FIGS. 5, 7, and 9 respectively show an equivalent circuit of a pixel circuit according to first through third embodiments of the present invention.
Figure 6:
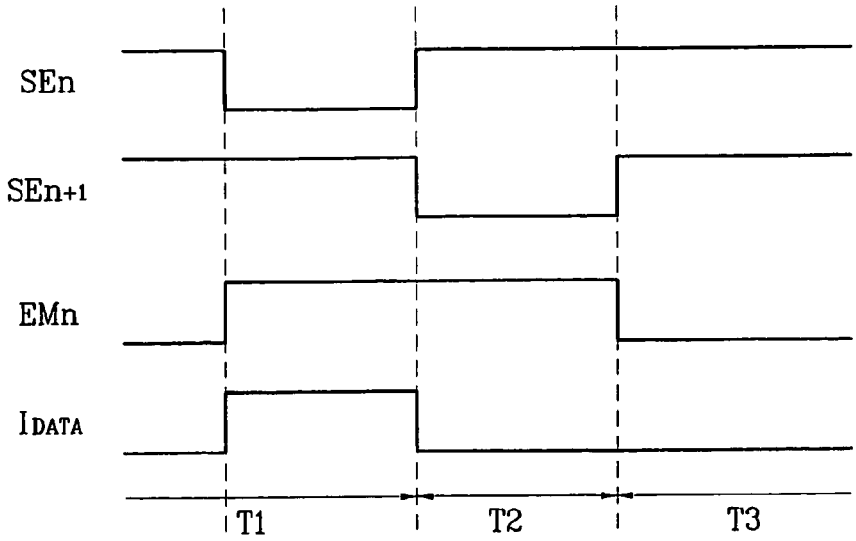
FIGS. 6 and 8 respectively show a driving waveform for driving the pixel circuit of FIGS. 5 and 7.

Referring to FIGS. 5 and 6, pixel circuit 11 of the organic EL display according to the first embodiment of the present invention will now be described. FIG. 5 shows an equivalent circuit diagram of the pixel circuit according to the first embodiment, and FIG. 6 shows a driving waveform diagram for driving the pixel circuit of FIG. 5. In this instance, for ease of description, FIG. 5 shows a pixel circuit coupled to an m-th data line $D_m$ and an n-th scan line $S_n$.

As shown in FIG. 5, pixel circuit 11 includes an OLED, PMOS transistors M1 through M7, and capacitors C1 and C2. The transistor is preferably a thin film transistor having a gate electrode, a drain electrode, and a source electrode formed on the glass substrate as a control electrode and two main electrodes.

Transistor M1 has a source coupled to power supply voltage VDD, and a gate coupled to transistor M5, and transistor M3 is coupled between the gate and a drain of transistor M1. Transistor M1 outputs current $I_{OLED}$ corresponding to a voltage $V_{GS}$ at the gate and the source thereof. Transistor M3 diode-connects transistor M1 in response to a select signal $SE_{n+1}$ from the scan line $S_{n+l}$ coupled to a pixel circuit provided on the (n+1)th row. The transistor M7 is coupled between the data line $D_m$ and the gate of the transistor M1, and diode-connects the transistor M1 in response to a select signal $SE_n$ from the scan line $S_n$. In this instance, the transistor M7 can be coupled between the gate and the drain of transistor M1 in the like manner of transistor M3.

Capacitor C1 is coupled between power supply voltage VDD and the gate of transistor M1, and capacitor C2 is coupled between power supply voltage VDD and a first end of transistor M5. Capacitors C1 and C2 operate as storage elements for storing the voltage between the gate and the source of the transistor. A second end of transistor M5 is coupled to the gate of transistor M1, and transistor M6 is coupled in parallel to transistor M5. Transistor M5 couples capacitors C1 and C2 in parallel in response to select signal $SE_n$ from scan line $S_n$, and transistor M6 couples capacitors C1 and C2 in parallel in response to an emit signal $EM_n$ from scan line $E_n$.

Transistor M2 transmits data current $I_{DATA}$ from data line $D_m$ to transistor M1 in response to a select signal $SE_n$ from scan line $S_n$. Transistor M4 coupled between the drain of transistor M1 and the OLED, transmits current $I_{OLED}$ of transistor M1 to the OLED in response to an emit signal $EM_n$ of scan line $E_n$. The OLED is coupled between transistor M4 and the reference voltage, and emits light corresponding to applied current $I_{OLED}$.

Referring to FIG. 6, an operation of the pixel circuit according to the first embodiment of the present invention will now be described in detail.

As shown, in interval T1, transistor M5 is turned on because of low-level select signal $SE_n$, and capacitors C1 and C2 are coupled in parallel between the gate and the source of transistor M1. Transistors M2 and M7 are turned on to diode-connect transistor M1, and transistor M2 is turned on to have data current $I_{DATA}$ from data line Dm flow to transistor M1. Since data current $I_{DATA}$ flows to transistor M1, data current $I_{DATA}$ can be expressed as Equation 3, and the gate-source voltage $V_{GS}$ (T1) in interval T1 is given as Equation 4 derived from Equation 3.

$$I_{DATA} = \frac{\beta}{2}(|V_{GS}(T1)| - |V_{TH}|)^2 \quad \text{Equation 3}$$

$$|V_{GS}(T1)| = \sqrt{\frac{2I_{DATA}}{\beta}} + |V_{TH}| \quad \text{Equation 4}$$

where β is a constant, and $V_{TH}$ is a threshold voltage of transistor M1.

Therefore, capacitors C1 and C2 store the voltage $V_{GS}$ (T1) corresponding to data current $I_{DATA}$. Transistor M4 is turned off by a high-level emit signal $EM_m$ to intercept the current to the OLED.

Next, in interval T2, transistors M2, M5, and M7 are turned off in response to a high-level select signal $SE_n$, and transistor M3 is turned on in response to a low-level select signal $SE_{n+1}$. Transistor M6 is currently turned off by high-level emit signal $EM_m$. Capacitor C2 is floated by turned-off transistors M5 and M6 while capacitor C2 stores the voltage expressed in Equation 4. Since data current $I_{DATA}$ is intercepted by turned-off transistor M2, and transistor M1 is diode-connected by turned-on transistor M3, capacitor C1 stores the threshold voltage $V_{TH}$ of transistor M1.

In interval T3, transistor M3 is turned off in response to high-level select signal $SE_{n+1}$, and transistors M4 and M6 are turned off in response to the low-level emit signal. When transistor M6 is turned on, capacitors C1 and C2 are coupled in parallel, and the gate-source voltage $V_{GS}(T3)$ at transistor M1 in interval T3 becomes Equation 5 because of coupling of capacitors C1 and C2.

$$|V_{GS}(T3)| = |V_{TH}| + \frac{C_2}{C_1 + C_2}(|V_{GS}(T1)| - |V_{TH}|) \quad \text{Equation 5}$$

where C1 and C2 are respectively capacitance of capacitors C1 and C2.

Therefore, current $I_{OLED}$ flowing to transistor M1 becomes as Equation 6, and current $I_{OLED}$ is supplied to the OLED because of turned-on transistor M4, to thereby emit light. That is, in interval T3, the voltage is provided and the OLED emits light because of coupling of capacitors C1 and C2.

$$I_{OLED} = \frac{\beta}{2}\left\{\frac{C_2}{C_1 + C_2}(|V_{GS}(T1)| - |V_{TH}|)\right\}^2 = \left(\frac{C_2}{C_1 + C_2}\right)^2 I_{DATA} \quad \text{Equation 6}$$

As expressed in Equation 6, since current $I_{OLED}$ supplied to the OLED is determined with no relation to the threshold voltage $V_{TH}$ of transistor M1 or the mobility, the deviation of the threshold voltage or the deviation of the mobility can be corrected. Also, current $I_{OLED}$ supplied to the OLED is C1/(C1+C2) squared times smaller than data current $I_{DATA}$. For example, if C1 is M times greater than C2 (C1=M×C2), the fine current flowing to the OLED can be controlled: by data current $I_{DATA}$ which is $(M+1)^2$ times greater than current $I_{OLED}$, thereby enabling representation of high gray. Further, since large data current $I_{DATA}$ is supplied to data lines $D_1$ through $D_m$, charging time for the data lines can be sufficiently obtained. Also, since transistors M1 through M7 are of the same type, it is easy to form the TFTs on the glass substrate of display panel 10.

In the first embodiment, PMOS transistors are used to realize transistors M1 through M7, and NMOS transistors can also be used to realize the same. In the case of realizing transistors M1 through M5 with NMOS transistors, the source of transistor M1 is coupled to not power supply voltage VDD but the reference voltage, the cathode of the OLED is coupled to transistor M4, and the anode thereof is coupled to power supply voltage VDD in the pixel circuit of FIG. 5. Select signals $SE_n$ and $SE_{n+1}$ have an inverted format of the waveform of FIG. 6. Since a detailed description of applying the NMOS transistors to transistors M1 through M5 can be easily known by the description of the first embodiment, no further detailed description will be provided. Also, transistors M1 through M7 can be realized by combination of PMOS and NMOS transistors, or other switches performing similar functions.

Seven transistors M1 through M7 are used to realize the pixel circuit in the first embodiment, and in addition, the number of transistors can be reduced by adding a scan line for transmitting a control signal, which will now be described with reference to FIGS. 7 through 12.

Figure 7:
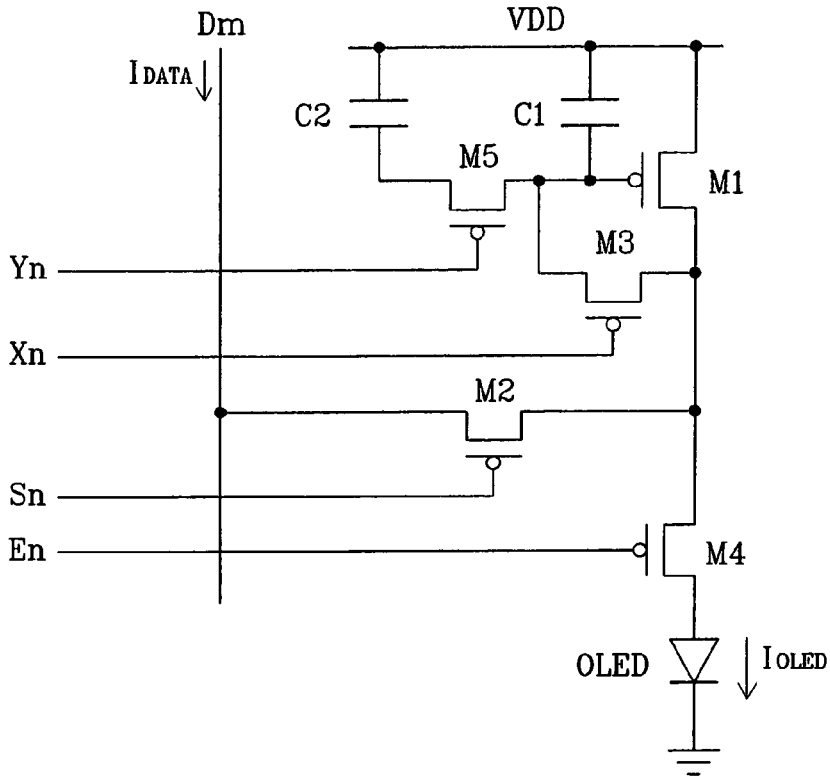
Figure 8:
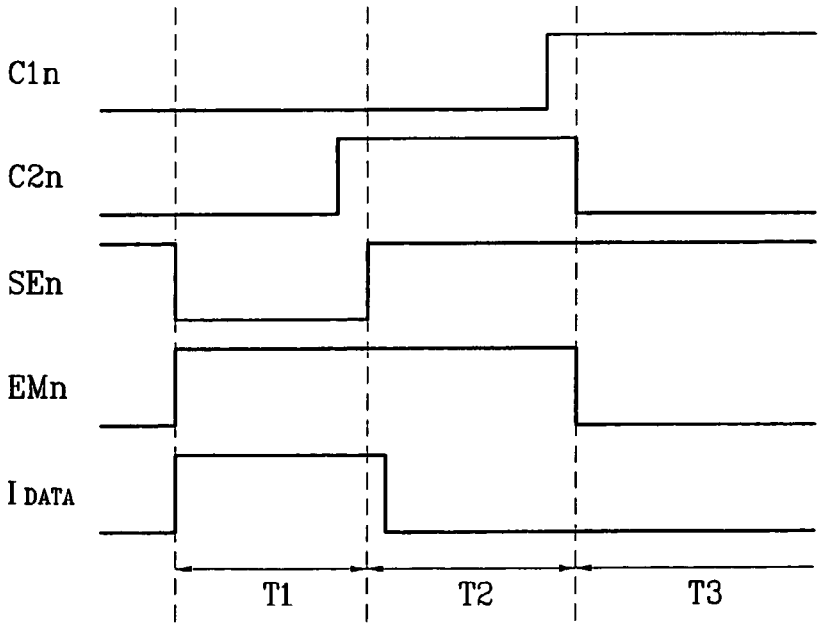

FIG. 7 shows an equivalent circuit diagram of the pixel circuit according to a second embodiment of the present invention, and FIG. 8 shows a driving waveform diagram for driving the pixel circuit of FIG. 7.

As shown in FIG. 7, transistors M6 and M7 are removed from and scan lines Xn and Yn are added to the pixel circuit of FIG. 5, in the pixel circuit according to the second embodiment. The gate of transistor M3 is coupled to scan line Xn, and diode-connects transistor M1 in response to control signal $CS1_n$ from scan line Xn. The gate of transistor M5 is coupled to scan line Yn and couples capacitors C1 and C2 in parallel in response to control signal $CS2_n$ from scan line Yn.

Referring to FIG. 8, transistors M3 and M5 are turned on by low-level control signals $CS1_n$ and $CS2_n$ to diode-connect transistor M1 and couple capacitors C1 and C2 in parallel. Transistor M2 is turned on by low-level select signal $SE_n$ to have data current $I_{DATA}$ from data line $D_m$ flow to transistor M1. Therefore, the gate-source voltage $V_{GS}(T1)$ is given as Equation 4 in a like manner of interval T1 according to the first embodiment, and the voltage $V_{GS}(T1)$ is stored in capacitors C1 and C2.

Next, in interval T2, transistor M5 is turned off by high-level control signal $CS2_n$ to float capacitor C2 while it is charged. Transistor M2 is turned off by high-level select signal $SE_n$ to intercept data current $I_{DATA}$. Therefore, capacitor C1 stores threshold voltage $V_{TH}$ of transistor M1 in the same manner of interval T2 according to the first embodiment.

In interval T3, transistor M3 is turned off by high-level control signal $CS1_n$, and transistor M5 is turned off in response to low-level control signal $CS2_n$. When transistor M5 is turned on, capacitors C1 and C2 are coupled in parallel, and the gate-source voltage $V_{GS}(T3)$ of transistor M1 in interval T3 is given as Equation 5 in the same manner of interval T3 according to the first embodiment.

As described, the pixel circuit according to the second embodiment operates in the same manner of the first embodiment, but the number of transistors is reduced compared to that of the first embodiment.

In the second embodiment, the number of transistors is reduced by two, and the number of scan lines is increased by two. Further, it is also possible to reduce the number of transistors by one and increase the number of scan lines by one.

For example, transistor M6 is removed from the pixel circuit of FIG. 5, and the gate of transistor M5 is coupled to scan line Yn for transmitting control signal $CS2_n$ as shown in FIG. 7. Transistor M5 is turned on in intervals T1 and T3 with low-level control signal $CS2_n$ to thereby couple capacitors C1 and C2 in parallel, which has the same operation as that of the first embodiment.

Also, transistor M7 is removed from the pixel circuit of FIG. 5, and the gate of transistor M3 is coupled to scan line Xn for transmitting control signal $CS1_n$ as shown in FIG. 7. Transistor M3 is turned on in intervals T1 and T2 with low-level control signal $CS1_n$ to thereby diode-connect transistor M1, which has the same operation as that of the first embodiment.

In the first and second embodiments, capacitors C1 and C2 are coupled in parallel to power supply voltage VDD, and differing from this, capacitors C1 and C2 can be coupled in series to power supply voltage VDD, which will now be described referring to FIG. 9.

Figure 9:
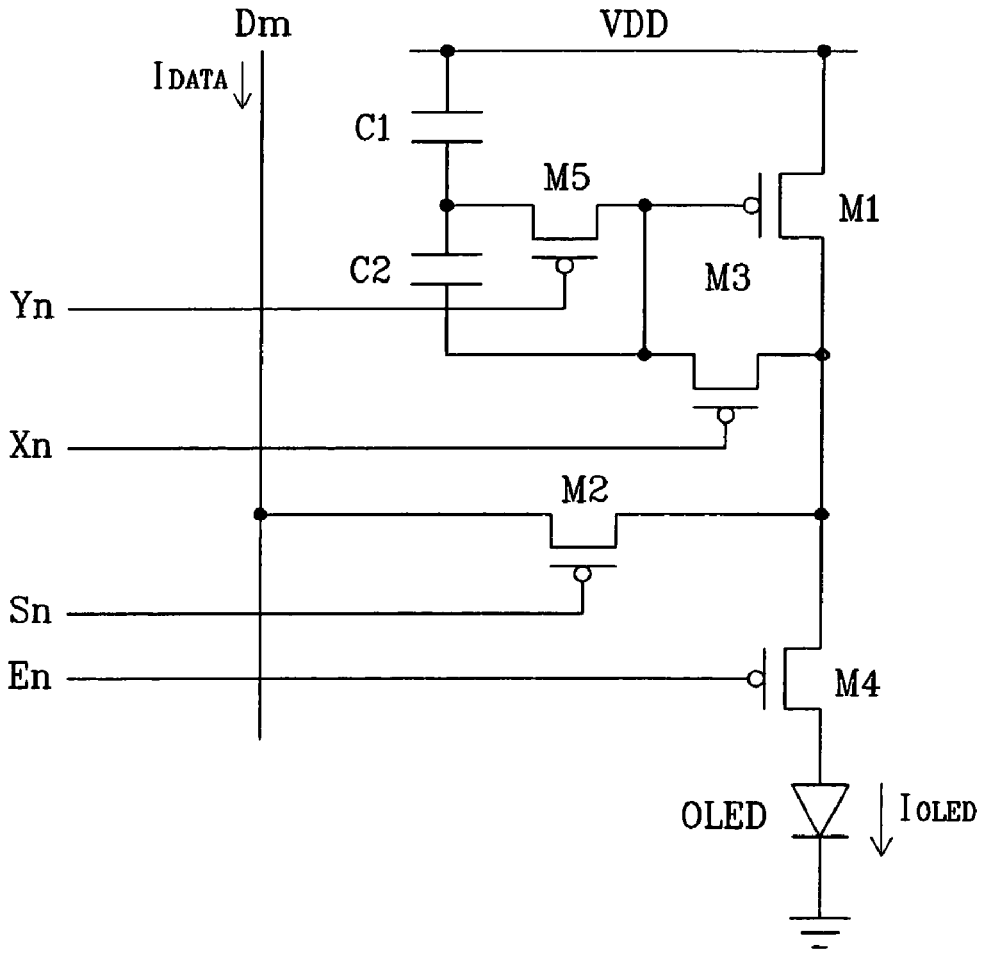

FIG. 9 shows an equivalent circuit diagram of the pixel circuit according to a third embodiment of the present invention.

As shown, the pixel circuit has the same structure as that of the second embodiment except the coupling states of capacitors C1 and C2, and transistor M5. In detail, capacitors C1 and C2 are coupled in series between power supply voltage VDD and transistor M3, and transistor M5 is coupled between the common node of capacitors C1 and C2 and the gate of transistor M1.

The pixel circuit according to the third embodiment is driven with the same driving waveform as that of the second embodiment, which will now be described referring to FIGS. 8 and 9.

In interval T1, transistor M3 is turned on by low-level control signal $CS1_n$ to diode-connect transistor M1. Transistor M5 is turned on by low-level control signal CS1n to make the voltage at capacitor C2 0V. Transistor M2 responds to low-level select signal $SE_n$ to have data current $I_{DATA}$ from the data line flow to transistor M1. The gate-source voltage $V_{GS}$(T1) of transistor M1 is given as Equations 3 and 4 by data current $I_{DATA}$ Also, transistor M4 is turned off by high-level emit signal $EM_n$ to intercept the current flow to the OLED.

In interval T2, control signal $CS2_n$ becomes high level to turn off transistor M5, and select $SE_n$ becomes high level to turn off transistor M2. Since transistor M1 is diode-connected by turned-on transistor M3, the threshold voltage $V_{TH}$ at transistor M1 is applied to capacitors C1 and C2 coupled in series. Hence, the voltage $V_{C1}$ at capacitor C1 charging the voltage $V_{GS}$(T1) shown in FIG. 4 becomes as shown in Equation 7 because of coupling of capacitors C1 and C2.

$$V_{C1} = |V_{TH}| + \frac{C_2}{C_1 + C_2}(|V_{GS}(T1)| - |V_{TH}|) \quad \text{Equation 7}$$

Next, in interval T3, transistor M3 is turned off in response to high-level control signal $CS1_n$, and transistors M5 and M4 are turned on by low-level-control signal $CS2_n$ and emit signal $EM_n$. When transistor M3 is turned off, and transistor M5 is turned on, the voltage $V_{C1}$ at capacitor C1 becomes the gate-source voltage $V_{GS}$(T3) of transistor M1. Therefore, current $I_{OLED}$ flowing to transistor M1 becomes as shown in Equation 8, and current $I_{OLED}$ is supplied to the OLED according to transistor M4 thereby emitting light.

$$I_{OLED} = \frac{\beta}{2}\left\{\frac{C_1}{C_1 + C_2}(|V_{GS}(T1)| - |V_{TH}|)\right\}^2 = \left(\frac{C_1}{C_1 + C_2}\right)^2 I_{DATA} \quad \text{Equation 8}$$

In the like manner of the first embodiment, current $I_{OLED}$ supplied to the OLED is determined with no relation to the threshold voltage $V_{TH}$ of transistor M1 or the mobility in the third embodiment. Also, since the fine current flowing to the OLED using data current $I_{DATA}$ that is (C1+C2)/C1 squared times current $I_{OLED}$ can be controlled, high gray can be represented. By supplying large data current $I_{DATA}$ to data lines $D_1$ through $D_M$, sufficient charging time of the data lines can be obtained.

In the third embodiment, PMOS transistors are used to realize transistors M1 through M5, and further the pixel circuit can be realized by NMOS transistors, combination of the PMOS and NMOS transistors, or other switches performing similar functions.

According to the present invention, since the current flowing to the OLED can be controlled by a large data current, sufficient data lines can be sufficiently charged for a single line time. Also, the threshold voltage of the transistor or deviation of mobility is corrected according to the current flowing to the OLED, and light emitting display with high resolution and wide screen can be realized.

While this invention has been described in connection with what is presently considered to be practical embodiments it is to be understood that the invention is not limited to the disclosed embodiments, but, on the contrary, is intended to cover various modifications and equivalent arrangements included within the spirit and scope of the appended claims.

What is claimed is:

1. A light emitting display comprising:

display panel on which are formed a plurality of data lines for transmitting data current that displays video signals, a plurality of scan lines for transmitting a select signal, and a plurality of pixel circuits formed at a plurality of pixels defined by the data lines and the scan lines, wherein at least one pixel circuit includes:

a light emitting element for emitting light corresponding to an applied current;

a first transistor, having a first main electrode, a second main electrode and a control electrode, for supplying a driving current for the light emitting element;

a first switch for diode-connecting the first transistor in response to a first control signal;

a second switch for transmitting a data signal from the data line in response to the select signal from the scan line;

a first storage element for storing a first voltage corresponding to the data current from the second switch in response to a second control signal;

a second storage element for storing a second voltage corresponding to a threshold voltage of the first transistor in response to a disable level of the second control signal; and a third switch for transmitting the driving current from the first transistor to the light emitting element in response to a third control signal, wherein the second voltage is applied to the second storage element after the first voltage is applied to the first storage element, and a third voltage stored in the first storage element is applied to the first transistor by coupling of the first and second storage elements to output the driving current.

2. The light emitting display of claim 1, wherein the light emitting display operates in the order of:

a first interval for enabling the first and second control signals and the first select signal to store the first voltage in the first storage element;

a second interval for enabling the first control signal and disabling the second control signal and the first select signal to store the second voltage in the second storage element; and a third interval for disabling the first control signal and enabling the third control signal to supply the driving current corresponding to the third voltage to the light emitting element.

3. The light emitting display of claim 1, wherein the pixel circuit further comprises a fourth switch that is turned on in response to the second control signal and has a first end coupled to a control electrode of the first transistor;

the fourth switch is turned on to form the first storage element; and the fourth switch is turned off to form the second storage element.

4. The light emitting display of claim 3, wherein the second storage element is formed by a first capacitor coupled between a control electrode and a first main electrode of the first transistor; and the first storage element is formed by parallel coupling of first and second capacitors, the second capacitor being coupled between the first main electrode of the first transistor and a second end of the fourth switch.

5. The light emitting display of claim 3, wherein the first storage element is formed by a first capacitor coupled between a second end of the fourth switch and a first main electrode of the first transistor; and the second storage element is formed by serial coupling of first and second capacitors, the second capacitor being coupled between the second end of the fourth switch and the control electrode of the first transistor.

6. The light emitting display of claim 3, wherein the first control signal is formed by the first select signal and a second select signal from a next scan line having an enable interval after the first select signal; and the first switch includes a second transistor for diode-connecting the first transistor in response to the first select signal, and a third transistor for diode-connecting the first transistor in response to the second select signal.

7. The light emitting display of claim 3, wherein the second control signal is formed by the first select signal and the third control signal;

the pixel circuit further comprises a fifth switch coupled in parallel to the fourth switch; and the fourth and fifth switches are respectively turned on in response to the first select signal and the third control signal.

8. The light emitting display of claim 3, wherein the first control signal is formed by the first select signal and a second select signal from a next scan line having an enable interval after the first select signal;

the second control signal is formed by the first select signal and the third control signal;

the first switch includes a second transistor for diode-connecting the first transistor in response to the first select signal, and a third transistor for diode-connecting the first transistor in response to the second select signal;

the pixel circuit further comprises a fifth switch coupled in parallel to the fourth switch, and the fourth switch and the fifth switch are turned on in response to the first select signal and the third control signal.

9. A method for driving a light emitting display including a pixel circuit including a switch for transmitting a data current from a data line in response to a select signal from a scan line, a transistor including a first main electrode, a second main electrode and a control electrode for outputting a driving current in response to the data current, and a light emitting element for emitting light corresponding to the driving current from the transistor, the method comprising:

storing a first voltage corresponding to a data current from the switch in a first storage element formed between the control electrode and the first main electrode of the transistor;

applying a second voltage corresponding to a threshold voltage of the transistor to a second storage element formed between the control electrode and the first main electrode of the transistor;

coupling the first and second storage elements to establish the voltage between the control electrode and the first main electrode of the transistor as a third voltage; and transmitting the driving current from the transistor to the light emitting display;

wherein the driving current from the transistor is determined corresponding to the third voltage.

10. The method of claim 9, wherein the first storage element includes a first capacitor and a second capacitor coupled in parallel between the control electrode and the first main electrode of the transistor;

the second storage element includes the first capacitor; and the third voltage is determined by parallel coupling of the first capacitor and the second capacitor.

11. The method of claim 9, wherein the first storage element includes a first capacitor coupled between the control electrode and the first main electrode of the transistor;

the second storage element includes the first capacitor and a second capacitor coupled between the first capacitor and the control electrode of the transistor; and the third voltage is determined by the first capacitor.

12. The method of claim 9, further comprising diode-connecting the transistor in response to a first control signal;

forming the first storage element in response to a first level of a second control signal;

providing the data current in response to a first select signal from the scan line;

applying the first voltage to the first storage element;

forming the second storage element in response to a second level of the second control signal;

applying the second voltage to the second storage element;

forming the first storage element for storing the third voltage in response to a second level of the second control signal; and transmitting the driving current to the light emitting element in response to a third control signal.

13. The method of claim 12, wherein the first control signal is formed by the first select signal; and the second control signal is formed by a second select signal from a next scan line having an enable interval after the first select signal.

14. The method of claim 12, wherein a first level of the second control signal is formed by the first select signal; and a first level of the second control signal is formed by the third control signal.

15. The method of claim 12, wherein a first level of the second control signal and the first control signal are formed by the first select signal;

the first control signal is formed by a second select signal from a next scan line having an enable interval after the first select signal; and a first level of the second control signal is formed by the third control signal.

16. A display panel of a light emitting display comprising:

a plurality of data lines for transmitting the data current that displays video signals;

a plurality of scan lines for transmitting a select signal; and a plurality of pixel circuits formed at a plurality of pixels defined by the data lines and the scan lines are formed, wherein at least one of the pixel circuits includes:

a light emitting element for emitting light corresponding to the applied current;

a first transistor for outputting the current for driving the light emitting element;

a first switch for transmitting the data current from the data line to the first transistor in response to a first select signal from the scan line;

a second switch diode-connecting the first transistor in response to a first control signal;

a third switch for operating in response to a second control signal;

a fourth switch for transmitting the driving current from the transistor to the light emitting element in response to a third control signal;

a first storage element formed between a control electrode and a first main electrode of the first transistor when the third switch is turned on; and a second storage element formed between the control electrode and the first main electrode of the first transistor when the third switch is turned off;

wherein the display panel operates in the order of: a first interval for applying a first voltage corresponding to the data current to the first storage element, a second interval for applying a second voltage corresponding to a threshold voltage of the first transistor to the second storage element, and a third interval for generating the driving current by a third voltage stored in the first storage element by the first and second voltages.

17. The display panel of claim 16, wherein the first interval operates by enable levels of the first select signal and the first and second control signals, and a disable level of the third control signal, the second interval operates by an enable level of the first control signal, and disable levels of the first select signal and the first control signal and the third control signal; and the third interval operates by enable levels of the second control signal and the third control signal, and disable levels of the first select signal and the first control signal.

18. The display panel of claim 17, wherein the enable levels of the first control signal in the first and second intervals are formed by the first select signal and a second select signal from a next scan line having an enable interval after the first select signal; and the second switch includes two transistors respectively responding to the first and second select signals.

19. The display panel of claim 17, wherein the enable levels of the second control signal in the first level and the third interval are formed by the first select signal and the third control signal; and the third switch includes two transistors respectively responding to the first select signal and the third control signal.

20. The display panel of claim 19, wherein the enable levels of the first control signal in the first and second intervals are formed by the first select signal and a second select signal from a next scan line having an enable interval after the first select signal; and the enable levels of the second control signal in the first level and the third interval are formed by the first select signal and the third control signal; and the second switch includes two transistors respectively responding to the first and second select signals; and the third switch includes two transistors respectively responding to the first select signal and the third control signal.

* * * * *